US008014712B2

(12) United States Patent
Lee et al.

(10) Patent No.: US 8,014,712 B2
(45) Date of Patent: Sep. 6, 2011

(54) FUSING DEVICE AND IMAGE FORMING APPARATUS HAVING THE SAME

(75) Inventors: Jae-hoon Lee, Seoul (KR); Jin-yoon Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 678 days.

(21) Appl. No.: 12/121,912

(22) Filed: May 16, 2008

(65) Prior Publication Data

US 2009/0003901 A1 Jan. 1, 2009

(30) Foreign Application Priority Data

Jun. 26, 2007 (KR) ..... 10-2007-0062764

(51) Int. Cl.
*G03G 15/20* (2006.01)

(52) U.S. Cl. ..... 399/331; 399/328; 399/330; 399/335; 399/67; 399/320

(58) Field of Classification Search ..... 399/328, 399/389, 330, 331, 335, 338, 67, 320
See application file for complete search history.

(56) References Cited

U.S. PATENT DOCUMENTS

| | | | | |
|---|---|---|---|---|
| 7,107,001 | B2 * | 9/2006 | Kameda | 399/328 |
| 2006/0257179 | A1 * | 11/2006 | Kim et al. | 399/322 |
| 2007/0020003 | A1 * | 1/2007 | Kang et al. | 399/328 |
| 2007/0217838 | A1 * | 9/2007 | Yamana et al. | 399/328 |

FOREIGN PATENT DOCUMENTS

JP 2002-229368 * 8/2002

OTHER PUBLICATIONS

Machine Translation of JP 2002-229368 Terada.*

* cited by examiner

*Primary Examiner* — David Porta
*Assistant Examiner* — Yara Green
(74) *Attorney, Agent, or Firm* — Staas & Halsey LLP

(57) ABSTRACT

A fusing device to fuse an image to a printing medium, the fusing device including: a heating roller; a first pressing roller, which presses the printing medium against the heating roller; and a second pressing roller which attached to the first pressing roller, to detach the printing medium from the first pressing roller. The first and second pressing rollers are biased against the heating roller such that the first and second pressing rollers move according to a change in a position of the heating roller.

22 Claims, 4 Drawing Sheets

FUSING DEVICE AND IMAGE FORMING APPARATUS HAVING THE SAME

CROSS-REFERENCE TO RELATED APPLICATION

This application claims the benefit of Korean Application No. 2006-62764, filed Jun. 26, 2007 in the Korean Intellectual Property Office, the disclosure of which is incorporated herein by reference.

BACKGROUND OF THE INVENTION

1. Field of the Invention

Apparatuses and methods, consistent with aspects of the present invention, relate to a fusing device including a separating roller, and an image forming apparatus including the same.

2. Description of the Related Art

In general, an image forming apparatus transfers a developed visible image onto a printing medium, and fuses the visible image to the printing medium with a fusing device. The fusing device includes a heating roller and a pressing roller, which rotate in contact with the heating roller. The fusing device fuses the visible image to the printing medium, with heat and pressure. However, the printing medium can become curled around the heating roller during the fusing process, due to the heat and the pressure. To solve this problem, a fusing device which further includes a separating roller, to separate the printing medium from the heating roller, has been developed.

In such a fusing device, pressing directions of the pressing roller and the separating roller face a rotational center of the heating roller. However, the rotational center of the heating roller may be moved from an initial position, by various causes, such as, abrasion, or a heat and pressure induced shape change, during the operation of the fusing device. In such circumstances, the relative contact positions of the separating roller and the heating roller move, and the pressing direction of the separating roller does not face the rotational center of the heating roller, thereby changing the pressure between the separating roller and the heating roller.

Accordingly, the curled printing medium can not be separated from the heating roller, thereby causing a jam of the printing medium. Also, since the pressure is often over-applied with respect to the heating roller, there may arise various problems, such as a localized abrasion of the heating roller.

SUMMARY OF THE INVENTION

Accordingly, it is an aspect of the present invention to provide a fusing device having a configuration in which the separating roller always faces the rotational center of the heating roller, even if the heating roller moves from its initial position, and an image forming apparatus having the same.

According to an aspect of the invention, a fusing device to fuse an image to a printing medium, includes: a heating roller; a first pressing roller, which moves to press the printing medium onto the heating roller; and a second pressing roller, which is supported on the first pressing roller, is engaged with a moving position of the first pressing roller, and moves to press the printing medium to the heating roller.

According to an aspect of the present invention, the fusing device further includes an arm member, which separately supports the second pressing roller, with respect to the first pressing roller.

According to an aspect of the present invention, the arm member includes: a first holding unit, which is supported on the first pressing roller; an arm unit which is extended from the first holding unit; and a second holding unit, which is disposed on an end of the arm unit and supports the second pressing roller.

According to an aspect of the present invention, the arm member can move in a direction where the second pressing roller presses the printing medium, and can further include an elastic member, which is disposed on the arm member, so that the second pressing roller can press the printing medium.

According to an aspect of the present invention, the elastic member is provided as a torsion spring, which is provided to press an area of the arm member, adjacent to where the second pressing roller is supported.

According to an aspect of the present invention, the fusing device further includes an elastic pressing unit, which biases the first pressing roller. The elastic pressing unit includes: a holder which supports the first pressing roller; and a holder elastic member which biases the holder toward the heating roller.

According to an aspect of the invention, an image forming apparatus, includes: a photoreceptor, on which an electrostatic latent image is formed; a developing unit, which supplies developer to the photoreceptor, and forms a visible image thereon; a transferring unit, which transfers the visible image from the photoreceptor onto the printing medium; and a fusing device, which fuses the visible image to the printing medium.

According to an aspect of the invention, a fusing device to fuse an image to a printing medium, includes: a heating roller; a first pressing roller, which presses the printing medium with respect to the heating roller; a second pressing roller, which presses the printing medium after having passed the first pressing roller, with respect to the heating roller; an elastic pressing unit, which elastically presses the first pressing roller; and an engaging pressing unit, which transmits some of pressure applied to the first pressing roller by the elastic pressing unit, to the second pressing roller, so that the second pressing roller can continue to press the printing medium.

According to an aspect of the present invention, the engaging pressing unit includes: an arm member, which separately supports the second pressing roller with respect to the first pressing roller; and an elastic member which is disposed on the arm member, so as to apply biasing pressure to an area of the arm member adjacent to the second pressing roller, toward the heating roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
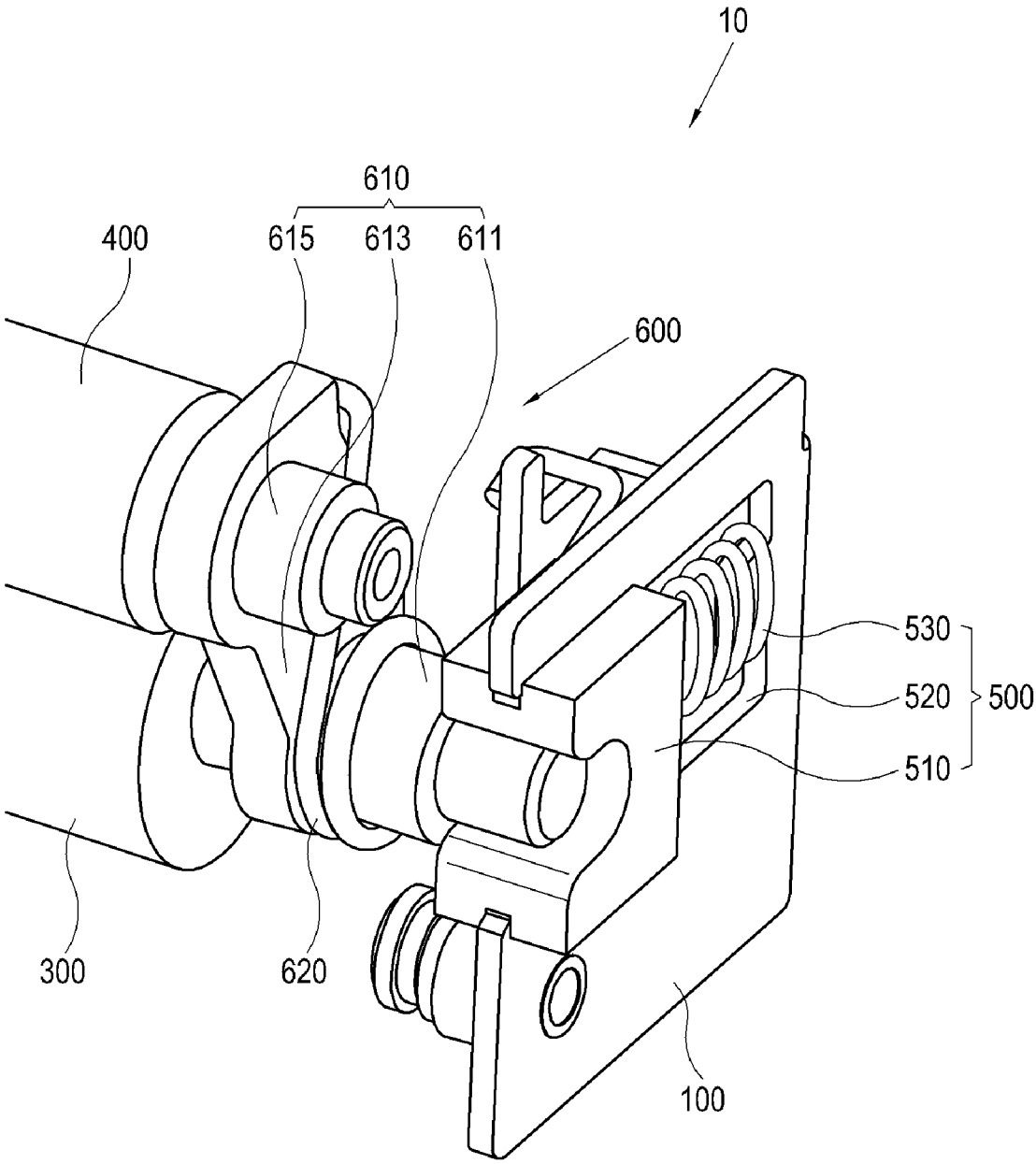
FIG. 1 is a perspective view illustrating a main part of a fusing device, according to an exemplary embodiment of the present invention.

Reference will now be made in detail to the exemplary embodiments of the present invention, examples of which are illustrated in the accompanying drawings, wherein like reference numerals refer to like elements throughout.

Figure 2:
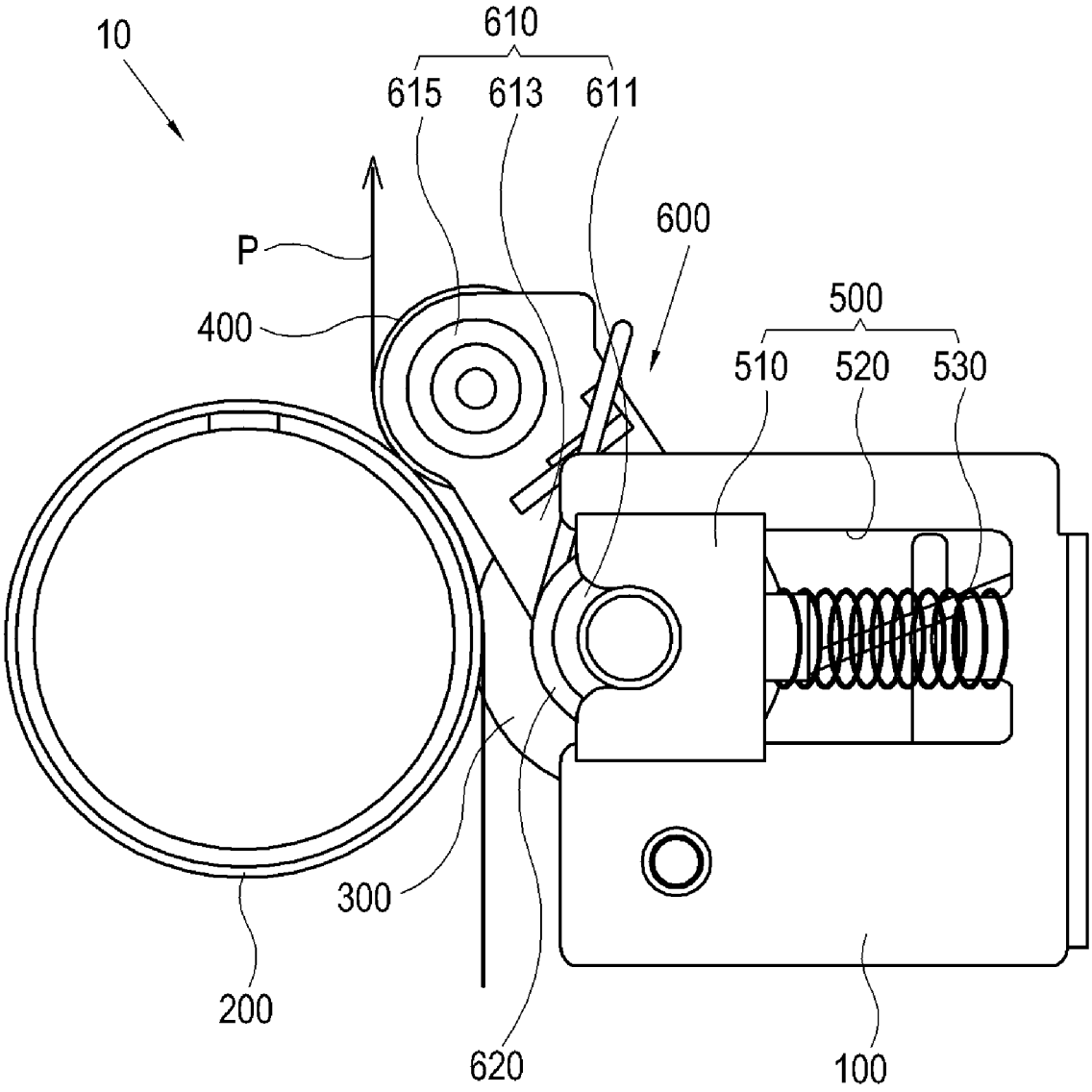
FIG. 2 is a side view of the fusing device in FIG. 1.

As shown in FIGS. 1 and 2, a fusing device 10 is provided, according to aspects of the present invention, to fuse a visible image made of developer to a printing medium P. The fusing device 10 includes: a supporting frame 100; a heating roller 200; a first pressing roller 300, which can move along the supporting frame 100, to contact an area of the heating roller 200; a second pressing roller 400, which is spaced from the first pressing roller 300 and contacts an opposing area of the heating roller 200; an elastic pressing unit 500, which elastically presses the first pressing roller 300 toward the heating roller 200; and an engaging pressing unit 600. The engaging pressing unit 600 supports a position of the second pressing roller 400, so as to be engaged with a moving position of the first pressing roller 300, and elastically presses the second roller 400 toward the heating roller 200.

The heating roller 200 includes a heat source (not shown) to heat the circumference of the heating roller 200 to a predetermined temperature. The surface of the printing medium P, on which a visible image is formed using developer is pressed onto the heating roller 200, by the first pressing roller 300.

The first pressing roller 300 to presses the printing medium P against the heating roller 200. The first pressing roller 300 rotates in contact with the heating roller 200, and a curved contacted area formed therebetween forms a fusing nip. The printing medium P passes between the heating roller 200 and the first pressing roller 300, (that is, passes through the above-described fusing nip.) and accordingly, the visible image is fused thereon.

The first pressing roller 300 is supported on the supporting frame 100, to approach and be separated from the heating roller 200. The first pressing roller 300 is elastically pressed toward the heating roller 200, by the elastic pressing unit 500, thereby pressing the printing medium P to the heating roller 200, as the printing medium P passes through the fusing nip. Although the heating roller 200 moves from an initial position, the first pressing roller 300 maintains contact with the heating roller 200, to form the fusing nip.

While the printing medium P passes between the first pressing roller 300 and the heating roller 200, heat and pressure is applied to the printing medium P. Accordingly, the printing medium P may not separate from the heating roller 200, and instead may curve around the heating roller 200, to thereby generate a jam. Accordingly, the second pressing roller 400 separates the printing medium P from the heating roller 200.

The second pressing roller 400 presses the printing medium P with the fused visible image with respect to the heating roller 200. Another nip is formed by a curved contact between the second pressing roller 400 and the heating roller 200. The nip curves toward the heating roller 200 and away from the second pressing roller 400. Accordingly, when the printing medium P passes through the another nip, the printing medium is bent toward the second pressing roller 400 and is separated from the heating roller 200. For this purpose, the second pressing roller 400 may have a higher hardness than the heating roller 200. to facilitate the curve formed in the heating roller 200.

The second pressing roller 400 is pressed along a line connecting the rotational center of the second pressing roller 400 and the rotational center of the heating roller 200. When the heating roller 200 is moved from its initial position, the second pressing roller 400 can maintain contact with a same are of the heating roller 200. Also, the pressing direction of the second pressing roller 400 may follow the line connecting the rotational center of the moved heating roller 200 and the rotational center of the second pressing roller 400.

The second pressing roller 400 is supported by the first pressing roller 300, which is supported by and moves along, the supporting frame 100. Accordingly, the second pressing roller 400 moves with the first pressing roller 300. That is, if the heating roller 200 is moved from an initial position, the first pressing roller 300 is moved to maintain contact with the heating roller 200, by the elastic pressing unit 500. Since the second pressing roller 400 is supported by the first pressing roller 300, the second pressing roller 400 moves with the first pressing roller 300, to maintain a pressure on and face the rotational center of the heating roller 200.

The elastic pressing unit 500 elastically presses (biases) the first pressing roller 300 toward the heating roller 200, so that the first pressing roller 300 can press the printing medium P against the heating roller 200. The elastic pressing unit 500 includes: a holder 510, which supports an end part of the first pressing roller 300; a holder guide 520, which is disposed in the supporting frame 100, to movably accommodate the holder 510; and a holder elastic member 530, which is disposed in the holder guide 520, to bias the holder 510. As used herein, "biasing" or "biasing pressure" refers to continuously or near continuously applying pressure to an element, such as through use of a spring or other like element.

The holder 510 is accommodated in the holder guide 520, and is guided by the holder guide 520 to move along the supporting frame 100. The holder 510 supports the end part of the first pressing roller 300, so that the first pressing roller 300 can rotate in contact with the heating roller 200. The holder 510 is biased by the holder elastic member 530, to move along the holder guide 520 and bias the first pressing roller 300 against the heating roller 200. Accordingly, the first pressing roller 300 can continuously form a fusing nip with the heating roller 200.

The holder guide 520 is provided in the supporting frame 100, and accommodates the holder 520 and a holder elastic member 530. The holder guide 520 extends in a direction toward the heating roller 200.

The holder elastic member 530 is disposed between the holder 510 and an end part of the holder guide 520. The holder elastic member 530 can be, for example, a coil spring, a plate spring, or the like. The holder elastic member 530 biases the holder 510 toward the heating roller 200. Accordingly, the first pressing roller 300 can press the printing medium P against the heating roller 200, and the position of the first pressing roller 300 can be minutely adjusted so that the printing medium P can easily pass between the first pressing roller 300 and the heating roller 200. Alternatively, although the heating roller 200 is moved from its initial position, the holder 510 is pressed toward the heating roller 200, thereby forming the fusing nip between the first pressing roller 300 and the heating roller 200.

The engaging pressing unit 600 enables the second pressing roller 400 to move, according to the position of the first pressing roller 300, and maintains the pressing direction of the second pressing roller 400. The engaging pressing unit 600 transmits some of pressure applied to the first pressing roller 300, by the elastic pressing unit 500, to the second pressing roller 400, so that the second pressing roller 400 can press the printing medium P against the heating roller 200. That is, the engaging pressing unit 600 correlates the movements of the elastic pressing unit 500 to coordinate the positive of the first pressing roller 300 and the second pressing roller 400.

The engaging pressing unit 600 includes: an arm member 610, which supports the second pressing roller 400 with respect to the first pressing roller 300; and an elastic member 620, which is installed in the arm member 610. The elastic member 620 is attached to the frame 100 biases an area of the arm member 610, so that the second pressing roller 400 can be pressed toward the heating roller 200.

The arm member 610 supports the second pressing roller 400 with respect to the first pressing roller 300, so that the second pressing roller 400 is separate from the first pressing roller 300. Accordingly, the elastic pressing unit 500 moves the first pressing roller 300 and the second pressing roller 400.

The arm member 610 includes: the first holding unit 611, an arm unit 613 and a second holding unit 615. The first holding unit 611 is supported in one end part of the first pressing roller 300. The arm unit 613, has a bar shape and extends from the first holding unit 611 in a transverse direction with respect to a lengthwise direction of the first pressing roller 300. The second holding unit 615 is disposed at an end part of the arm unit 613, to support the second pressing roller 400. The first holding unit 611 and the second holding unit 615 support the rotational centers of the first pressing roller 300 and the second pressing roller 400, respectively. The first pressing roller 300 and the second pressing roller 400 can rotate in contact with the heating roller 200.

The arm member 610 is rotatable around the axis of the first holding unit 611. That is, the second holding unit 615 can move along a radius defined by the extended length of the arm unit 613 and the rotational center of the first holding unit 611. The rotational direction of the second holding unit 615 faces the rotational center of the heating roller 200.

The elastic member 620 biases the arm member 610, so that the second pressing roller 400 can be pressed toward the rotational center of the heating roller 200. That is, the elastic member 620 presses the second holding unit 615, so that the second holding unit 615 is moved toward the rotational center of the heating roller 200.

The elastic member 620 can be, for example, a torsion spring formed of wire, or the like. A first end of the elastic member 620 is supported on the supporting frame 100, and the elastic member 620 is wound around the first holding unit 611. A second end of the elastic member 620 presses against the second holding unit 615. The second end of the elastic member 620 biases the second holding unit 615 toward the heating roller 200. Here, the first end of the elastic member 620 may move along the supporting frame 100, so as not to interfere with the movement of the first pressing roller 300.

The above-described elastic member 620 is only an exemplary embodiment, and various design changes can be made thereto. For example, the elastic member 620 may be installed inside the first holding unit 611, to control the movement of the arm member 610. However, the elastic member 620 should not interfere with the pressure applied to the first pressing roller 300 by the elastic pressing unit 500.

Figure 3:
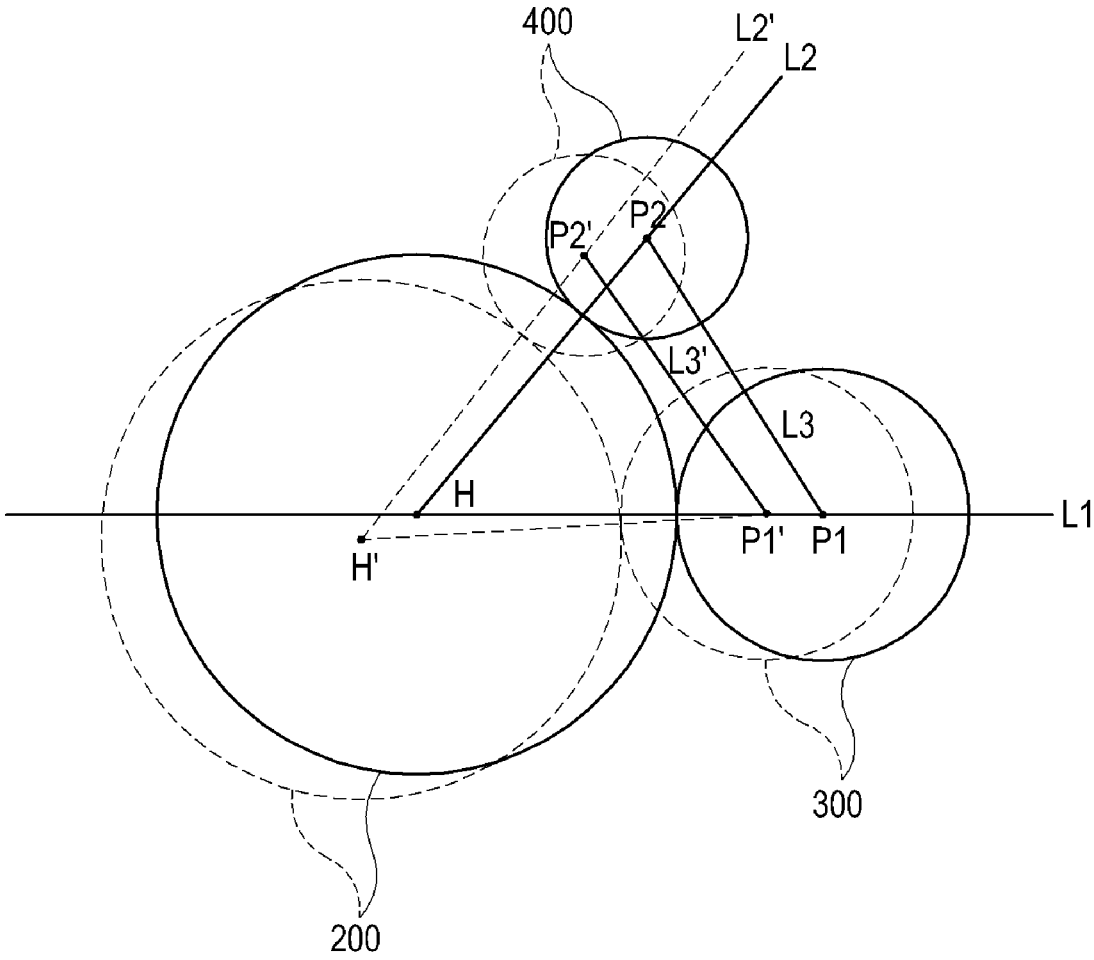
FIG. 3 is a schematic view illustrating an operation of the fusing device in FIG. 1.

An operating process of the fusing device 10 will be described by referring to FIGS. 1 through 3. The printing medium P enters the fusing nip between the heating roller 200 and the first pressing roller 300. A visible image is fused to the printing medium P, by heat and pressure applied at the fusing nip. As a result, the printing medium P is can be curved toward the heating roller 200, and can be said to be attached to the heating roller 200.

The second pressing roller 400 then presses the printing medium P against the heating roller 200. Since the second pressing roller 400 has a higher hardness than the heating roller, the printing medium P is bent toward the second pressing roller 400. Accordingly, the second pressing roller 400 separates the printing medium P from the heating roller 200. Here, the pressing direction may be on a line connecting the rotational center of the second pressing roller 400 and the rotational center of the heating roller 200, so that the second pressing roller 400 can easily separate the printing medium P from the heating roller 200.

The heating roller 200 may be moved from its initial position, during the operation of the fusing device 10. FIG. 3 is a schematic view illustrating an operating exemplary embodiment of the first pressing roller 300 and the second pressing roller 400, illustrating the movement of the heating roller 200. As shown in FIG. 3, points H, P1, and P2 denote initial positions of the rotational center of the heating roller 200, the first pressing roller 300, and the second pressing roller 400, respectively.

The first pressing roller 300 is supported on the holder 510 and is biased by the holder elastic member 530 against the heating roller 200. L1 is a line connecting the point P1 and the point H, (that is, a line connecting the rotational centers of the first pressing roller 300 and the heating roller 200). Accordingly, the first pressing roller 300 can move along the line L1.

L2 is a line connecting the point P2 and the point H, (that is, a line connecting the rotational centers of the second pressing roller 400 and the heating roller 200). The pressing direction of the elastic member 620 follows the line L2, as the elastic member 620 biases the second holding unit 615.

L3 is a line segment connecting the point P1 and the point P2, (that is, a line segment L3 connecting the rotational centers of the first pressing roller 300 and the second pressing roller 400). Since the second pressing roller 400 is supported on the first pressing roller 300, by the arm member 610, the length of the line segment L3 equals the distance between the first pressing roller 300 and the second pressing roller 400.

The rotational center of the heating roller 200 moves from the point H to a point H', to illustrate the movement of the heating roller 200 from its original position. Accordingly, the holder elastic member 530 elastically presses the holder 510 toward the heating roller 200. The rotational center of the first pressing roller 300 moves from the point P1 to a point P1'. The point P1' denotes one position between the point P1 and the point H, on the line L1.

As the rotational center of the first pressing roller 300 moves, the rotational center of the second pressing roller 400 also moves, in parallel with the line L1, according to the force applied by the holder elastic member 530. However, the elastic member 620 operates so that the rotational center of the second pressing roller 400 can rotate toward the heating roller 200, around the rotational center of the first pressing roller 300. As a result, the holder elastic member 530 and the elastic member 620 operate together, and accordingly, the rotational center of the second pressing roller 400 moves from the point P2 to a point P2'.

L3' is a line connecting the point P1' and the point P2', and the lengths of the line segments L3 and L3' are the same. L2' is a line connecting the point H' and the point P2', and the second pressing roller 400 is pressed along the line L2' toward the heating roller 200. Accordingly, although the heating roller 200 is moved from its initial position, the pressing direction of the second pressing roller 400 can always face the rotational center of the heating roller 200.

Figure 4:
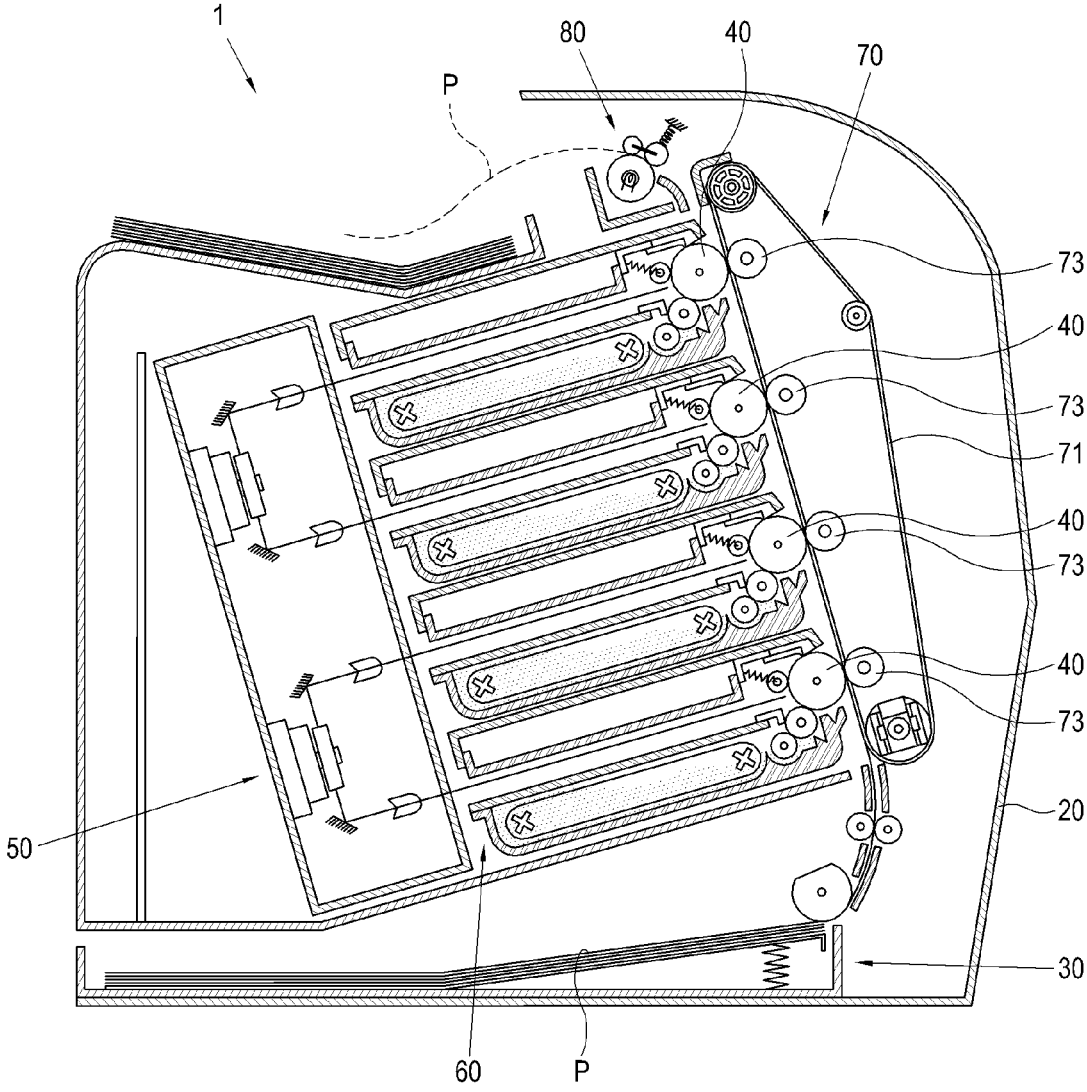
FIG. 4 is a side sectional view of an image forming apparatus, according to an exemplary embodiment of the present invention.

FIG. 4 is a sectional view illustrating an image forming apparatus 1, according to an exemplary embodiment of the present invention. As shown in FIG. 4, the image forming apparatus 1 includes: a main body 20; a medium feeding unit 30, which loads and feeds a printing medium P; a plurality of photoreceptors 40, on which electrostatic latent images are formed into toner images by the application of a developer; a light scanning unit 50, which forms the electrostatic latent images on the photoreceptors 40; a developing unit 60, which supplies the developer to the photoreceptors 40; a transferring unit 70, which transfers the toner images from the photoreceptors 40 onto the printing medium P as a visible image; and a fusing device (or unit) 80 which fuses the visible image on the printing medium P.

Four of the photoreceptors 40, which correspond to yellow, magenta, cyan, and black toners, are sequentially disposed along a transferring route of the printing medium P, so as to form a color image on the printing medium P. Circumferences of the photoreceptors 40 are electrified uniformly, and a potential difference is generated by a beam from the light scanning unit 50, thereby forming the electrostatic latent images thereon. Developer is supplied from the developing unit 60 to the photoreceptors 40 on which the electrostatic latent images are formed, to form the toner images on the photoreceptors 40.

The light scanning unit 50 scans the beam, so that an electrostatic latent image can be formed on each of the plurality of photoreceptors 40. The light scanning unit 50 divides image information according to color, and forms the electrostatic latent image on each of the photoreceptors 40 on the basis of the division.

The developing unit 60 is provided to correspond to the plurality of photoreceptors 40, provided according to a color of each of the developer. Accordingly, toner images having different colors are the photoreceptors 40.

The transferring unit 70 transfers the printing medium P sequentially past the plurality of photoreceptors 40, and accordingly, the toner images on each of the photoreceptors 40 are overlapped onto the printing medium P. For this purpose, the transferring unit 70 includes a transfer backup belt 71 and a transfer roller 73, which are disposed to face each of the photoreceptors 40. The printing medium P is moved along the transfer backup belt 71, and the toner images on the photoreceptors 40 are transferred onto the printing medium P, by a transfer bias applied to the transfer roller 73, to form a visible image.

The fusing device 80 fuses the visible image on the printing medium P by applying heat and pressure. The detailed description of the fusing device 80 will be omitted, as it is the same as the configuration of the fusing device 10 shown in FIGS. 1 and 2, according to the above-described exemplary embodiment.

As described above, in the fusing device 10, although the heating roller is moved from its initial position, the pressing direction and pressing force of the second pressing roller is kept uniform, thereby enhancing fusing quality of a visible image on a printing medium. Also, local abrasion of the heating roller is minimized, thereby increasing the lifetime of the unit (or device) and reducing an upkeep cost. In addition, the printing medium is not curled around the heating roller and is easily separated therefrom, thereby preventing a jam of the printing medium. Also, such a fusing device is applied to an image forming apparatus, thereby enhancing the reliability of the apparatus.

Although a few exemplary embodiments of the present invention have been shown and described, it would be appreciated by those skilled in the art that changes may be made in these exemplary embodiments without departing from the principles and spirit of the invention, the scope of which is defined in the appended claims and their equivalents.

What is claimed is:

1. A fusing device to fuse an image to a printing medium, the fusing device comprising:

a heating roller;

a first pressing roller to press the printing medium against the heating roller to fuse the image and to move in accordance with a change in position of the heating roller;

a second pressing roller connected to the first pressing roller, to detach the printing medium from the heating roller and to move with the first pressing roller, in accordance with the change in position of the heating roller;

a holder to support the first pressing roller, wherein the holder comprises a first elastic member to bias the first pressing roller toward the heating roller; and an arm member to support the second pressing roller, wherein the arm member comprises a second elastic member to bias the second pressing roller toward the heating roller.

2. The fusing device according to claim 1, wherein the arm member connects the second pressing roller to the first pressing roller.

3. The fusing device according to claim 1, wherein the arm member comprises:

a first holding unit to support the first pressing roller;

a second holding unit to support the second pressing roller; and an arm unit to connect the first and second holding units.

4. The fusing device according to claim 1, wherein the second elastic member biases the arm member, such that the second pressing roller moves according to the change in position of the heating roller and continues to press the heating roller.

5. The fusing device according to claim 1, wherein the second elastic member is a torsion spring to apply biasing pressure to the arm member at a position adjacent to the second pressing roller.

6. The fusing device according to claim 1, further comprising an elastic pressing unit to bias the first pressing roller against the heating roller, the elastic pressing unit comprising:

the holder to support the first pressing roller; and the first elastic member to bias the holder toward the heating roller, according to the change of the position of the heating roller.

7. An image forming apparatus that forms an image on a printing medium, comprising:

a photoreceptor on which an electrostatic latent image is formed;

a developing unit which supplies developer to the photoreceptor to form a visible image thereon;

a transferring unit to transfers the visible image from the photoreceptor onto the printing medium; and a fusing device according to claim 1, to fuse the visible image on the printing medium.

8. The fusing device according to claim 1, wherein the second pressing roller is harder than the heating roller.

9. A fusing device to fuse an image to a printing medium, the fusing device comprising:

a heating roller;

a first pressing roller to press the printing medium against the heating roller;

a second pressing roller to detach the printing medium from the heating roller;

an elastic pressing unit comprising a first elastic member to bias the first pressing roller against the heating roller; and an engaging pressing unit to transfer a portion of a biasing pressure applied to the first pressing roller by the elastic pressing unit, to the second pressing roller, such that the second pressing roller presses the printing medium, wherein the engaging pressing unit comprises a second elastic member to bias the second pressing roller toward the heating roller.

10. The fusing device according to claim 9, wherein the engaging pressing unit further comprises:

an arm member to connect the second pressing roller to the first pressing roller, wherein the second elastic member biases the arm member such that the second pressing roller is pressed against the heating roller.

11. The fusing device according to claim 8, wherein the second pressing roller is harder than the heating roller.

12. A fusing device to fuse an image to a printing medium, the fusing device comprising:

a heating roller;

a first pressing roller to press the printing medium against the heating roller;

a second pressing roller to detach the printing medium from the heating roller;

an elastic pressing unit comprising a first elastic member to bias the first pressing roller against the heating roller, according to a change in a position of the heating roller;

an arm member to connect the second pressing roller to the first pressing roller, wherein the arm member comprises a second elastic member to bias the second pressing roller against the heating roller, according to the change in the position of the heating roller.

13. The fusing device according to claim 12, wherein the second pressing roller is harder than the heating roller.

14. The fusing device according to claim 12, wherein the elastic pressing unit further comprises:

a holder to support the first pressing roller, wherein the first elastic member biases the holder toward the heating roller, according to the change of the position of the heating roller.

15. The fusing device according to claim 14, wherein the holder comprises a holder guide along which the holder moves, according to the change in position of the heating roller.

16. The fusing device according to claim 12, wherein the first elastic member is a coil spring or a plate spring.

17. The fusing device according to claim 12, wherein the arm member further comprises:

a first holding unit to support the first pressing roller;

a second holding unit to support the second pressing roller; and an arm unit to connect the first and second holding units, wherein the second elastic member biases the arm unit, such that the second pressing roller moves according to the change in position of the heating roller and continues to press the heating roller.

18. The fusing device according to claim 12, wherein the second elastic member is a torsion spring.

19. The fusing device according to claim 12, wherein the elastic pressing unit and the arm member are to respectively maintain the relative positions of the first pressing roller, the second pressing roller, and the heating roller, if the position of the heating roller changes.

20. A fusing device to fuse an image to a printing medium, the fusing device comprising:

a heating roller;

a first pressing roller to form a first nip to press the printing medium against the heating roller;

a second pressing roller to form a second nip to detach the printing medium from the heating roller;

an elastic pressing unit comprising a first elastic member to bias the first pressing roller and the second pressing roller against the heating roller, to maintain the first and second nips during a change in a position of the heating roller; and an engaging pressing unit comprising a second elastic member to bias the second pressing roller against the heating roller according to the change in the position of the heating roller.

21. The fusing device according to claim 20, wherein the engaging pressing unit further comprises an arm member to connect the second pressing roller to the first pressing roller.

22. The fusing device according to claim 20, wherein the first elastic member is a coil spring or plate spring, and the second elastic member is a torsion spring.

* * * * *

UNITED STATES PATENT AND TRADEMARK OFFICE

CERTIFICATE OF CORRECTION

PATENT NO. : 8,014,712 B2
APPLICATION NO. : 12/121912
DATED : September 6, 2011
INVENTOR(S) : Lee et al.

It is certified that error appears in the above-identified patent and that said Letters Patent is hereby corrected as shown below:

Column 1, Line 8, Delete "No. 2006-62764" and insert -- No. 2007-62764 --, therefor.

Column 9, Line 22, In Claim 11, delete "claim 8," and insert -- claim 9, --, therefor.

Signed and Sealed this
Seventh Day of February, 2012

David J. Kappos

David J. Kappos
*Director of the United States Patent and Trademark Office*